United States Patent [19]

Bakker et al.

[11] Patent Number: 4,811,483

[45] Date of Patent: Mar. 14, 1989

[54] DRY-SHAVING APPARATUS WITH SELF ADJUSTING BLADES

[75] Inventors: Eppe Bakker, Drachten; Eduard W. Tietjens, Eindhoven, both of Netherlands

[73] Assignee: U.S. Philips Corp., New York, N.Y.

[21] Appl. No.: 206,982

[22] Filed: Jun. 8, 1988

Related U.S. Application Data

[63] Continuation of Ser. No. 943,474, Dec. 16, 1986, abandoned.

[30] Foreign Application Priority Data

Dec. 20, 1985 [NL] Netherlands ..... 8503521

[51] Int. Cl.[4] ..... B26B 19/14

[52] U.S. Cl. ..... 30/43.6; 30/346.51

[58] Field of Search ..... 30/43.4, 43.5, 43.6, 30/43.9, 43.92, 346.51

[56] References Cited

U.S. PATENT DOCUMENTS 2,674,037 4/1954 Swenson ..... 30/43.6 X 2,890,523 6/1959 Bulova et al. ..... 30/43.6

FOREIGN PATENT DOCUMENTS 522053 7/1976 U.S.S.R. ..... 30/43.6

*Primary Examiner*—Douglas D. Watts

*Attorney, Agent, or Firm*—Ernestine C. Bartlett

[57] ABSTRACT

A dry-shaving apparatus comprises a longitudinally extending shear plate provided with hair-entry apertures; and an associated longitudinally extending cutter rotatable about an axis of rotation, such cutter including a spindle coaxially positioned with respect to the axis of rotation. The shear plate has a central portion shaped as a part of a cylindrical surface and formed with the hair-entry apertures, the central portion partly surrounding the cutter. Cutting elements movable relative to the cutter in a substantially radial direction are provided, each cutting element having a cutting edge at its radial end. More than two coaxial discs are axially spaced from each other and are formed with slots extending in a substantially radial direction, the coaxial discs being rigidly mounted on the spindle. Each cutting element has oppositely disposed axially projecting connecting portions for insertion of the cutting element into facing slots in two adjacent discs, the connecting portions being movable inside the slots in a substantially radial direction.

6 Claims, 3 Drawing Sheets

DRY-SHAVING APPARATUS WITH SELF ADJUSTING BLADES

This is a continuation of application Ser. No. 943,474, filed Dec. 16, 1986, now abandoned.

BACKGROUND OF THE INVENTION

This invention relates to a dry-shaving apparatus comprising a housing supporting a holder for a longitudinally extending shear plate provided with hair-entry apertures and an associated longitudinally extending cutter which is rotatable about an axis of rotation, which cutter has cutting elements whose radial ends are formed with cutting edges, the shear plate having a central portion which is shaped as a part of a cylindrical surface and which is formed with the hair-entry apertures, which central portion partly surrounds the cutter.

Such a dry-shaving apparatus is known, for example, from U.S. Pat. No. 3,710,442.

SUMMARY OF THE INVENTION

It is the object of the present invention to provide a cutter which can be manufactured inexpensively and which provides an effective shaving action and to this end the invention is characterized in that the cutter comprises coaxial discs which are axially spaced from each other and which are formed with slots which extend in a substantially radial direction, each cutting element having oppositely disposed axially projecting connecting portions by means of which a cutting element is supported in facing slots in two adjacent discs, the connecting portions being movable in the slots in a substantially radial direction.

BRIEF DESCRIPTION OF THE DRAWINGS

The invention will now be described in more detail with reference to the accompanying drawings, in which.

DETAILED DESCRIPTION OF THE PREFERRED EMBODIMENTS

Figure 1:
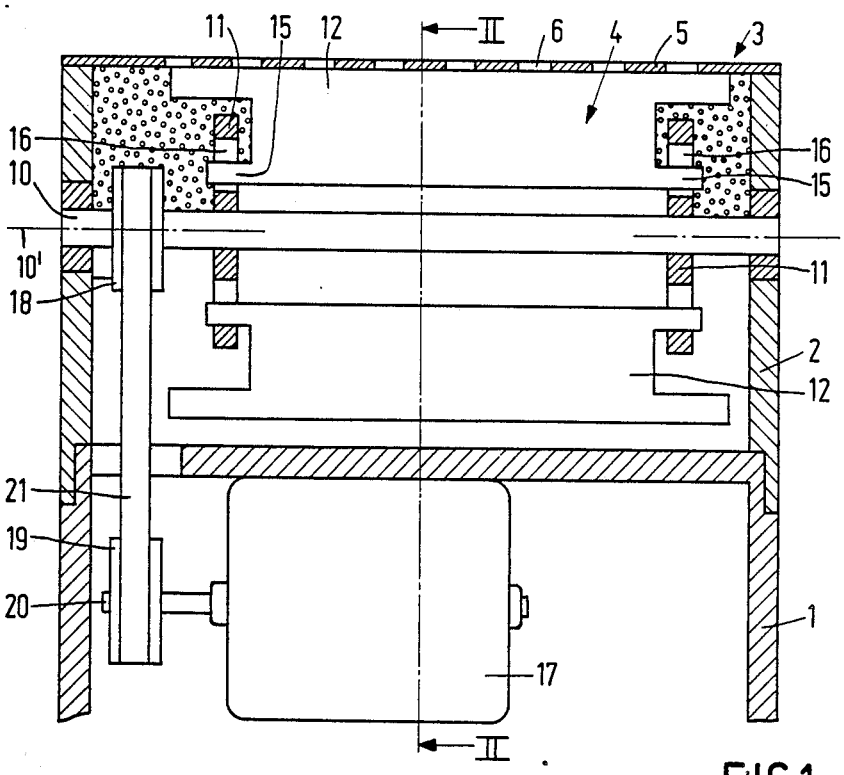
FIG. 1 is a schematic longitudinal sectional view of a dry-shaving apparatus in accordance with the invention.
Figure 2:
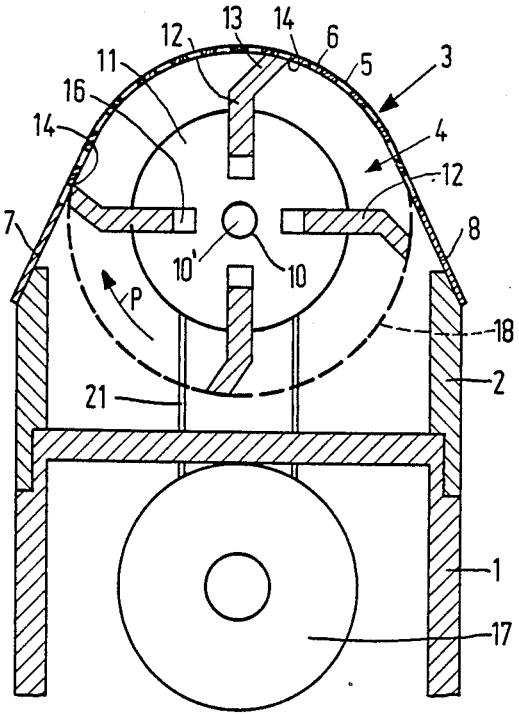
FIG. 2 is a sectional view taken on the line II—II in FIG. 1.

The dry-shaving apparatus shown in FIGS. 1 and 2 comprises a housing 1 supporting a holder 2 for a longitudinally extending shear plate 3 and a longitudinally extending cutter 4 which is rotatable relative to the shear plate.

The shear plate 3 has a central portion 5 provided with hair-entry apertures 6 and oppositedly disposed peripheral portions 7 and 8 by which the shear plate is secured to the holder 2. The central portion 5 partly surrounds the cutter 4.

The cutter 4 includes a spindle 10 and two discs 11 which are rigidly connected to or mounted on the spindle. Four cutting elements 12 are arranged between the discs and respectively have cutting edges 14 at their ends 13. The spindle 10 is journalled in the holder 2 so as to be rotatable about an axis of rotation 10'.

Preferably the cutting elements 12 are made of a sheet material and are respectively provided with oppositely disposed axially projecting connecting portions 15 which engage in corresponding slots 16 in the discs 11. The connecting portions 15 are movable in the slots 16 in a substantially radial directions. As a result, the cutting elements 12 are also movable relative to the discs 11 over a limited distance in a substantially radial direction. This enables the cutting elements to be pressed against the inner side of the shear plate 3 by the centrifugal force produced during rotation of the cutter 4. However, it is alternatively possible to urge the cutting elements 12 against the shear plate in a different way, for example by arranging pressure springs between the spindle 10 and the cutting elements 12.

For driving the cutter 4, for example in a direction of rotation as indicated by the arrow P in FIG. 2, an electric motor 17 is arranged inside the housing 1. Such rotation is transmitted from the electric motor 17 to the cutter 4, for example, by means of pulleys 18 and 19, mounted on the spindle 10 and the motor shaft 20 respectively, and a drive belt 21.

Hairs which project inwards through the hair-entry apertures 6 are severed by cooperation of the central portion 5 of the shear plate with the cutting edges 14 of the cutting elements of the rotating cutter.

Figure 3:
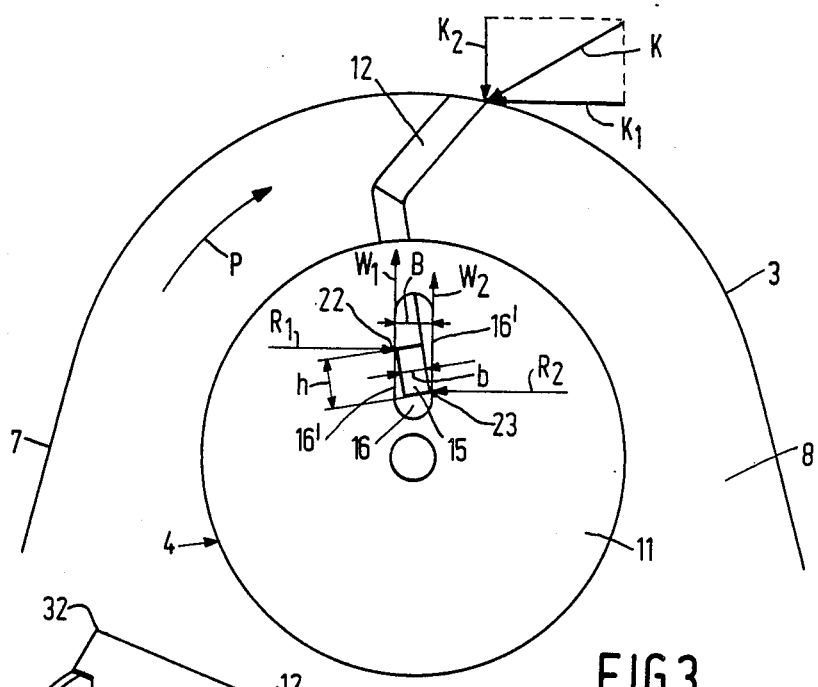
FIG. 3 is a schematic side view of a cutter and a shear plate.

FIG. 3 is a schematic side view of a cutter 4 and a shear plate 3 used in the embodiment shown in FIGS. 1 and 2, only one cutting element 12 and one slot 16 being shown for the sake of simplicity. The axially projecting connecting portion 15 is of rectangular cross-section, the thickness b being adapted to the width B of the slot 16, i.e. the clearance between the slot and the connecting portion being such as to enable the connecting portion to be radially movable inside the slot.

During cutting of a hair a cutting element 12 will generally experience a force K having a component $K_1$ which is directed oppositely to the local direction of rotation P. As a result of this force $K_1$ the cutting element 11 will be tilted slightly relative to the disc 12, the vertices 22 and 23 of the connecting portion 15 resting against the wall 16' of the slot 16. At the location of these vertices 22 and 23 the walls of the slot 16 will exert forces $R_1$ and $R_2$ respectively on the connecting portion. The forces $R_1$ and $R_2$ will give rise to frictional forces $W_1$ and $W_2$ respectively between the walls 16' of the slot 16 and the connecting portion 15, which forces counteract a displacement of the connecting portion 15 inside the slot 16. Thus, the cutting element 12 is mounted in the discs 11 in a self-locking manner, which means that the cutting element is not pressed inwards by the radial component $K_2$ of the force K during cutting of a hair. This self-tightening promotes an effective cutting action.

The magnitude of the couple of forces exerted on the cutting element by the forces $R_1$ and $R_2$ depends only on the magnitude of the force $K_1$ and on the arm between $R_1$ and $R_2$. This arm is substantially equal to the height h of the connecting portion 15 and is independent of the location of the connecting portion inside the slot. Since the forces $W_1$ and $W_2$ are proportional to the forces $R_1$ and $R_2$ respectively the self-locking effect is also independent of the location of the cutting element 12 relative to the discs 11. This mitigates the drawback of the known construction in which the self-locking effect increases as the cutting element moves in a radially outward direction, which may result in substantial forces between the shear plate and the cutting element and hence in damage.

Figure 4:
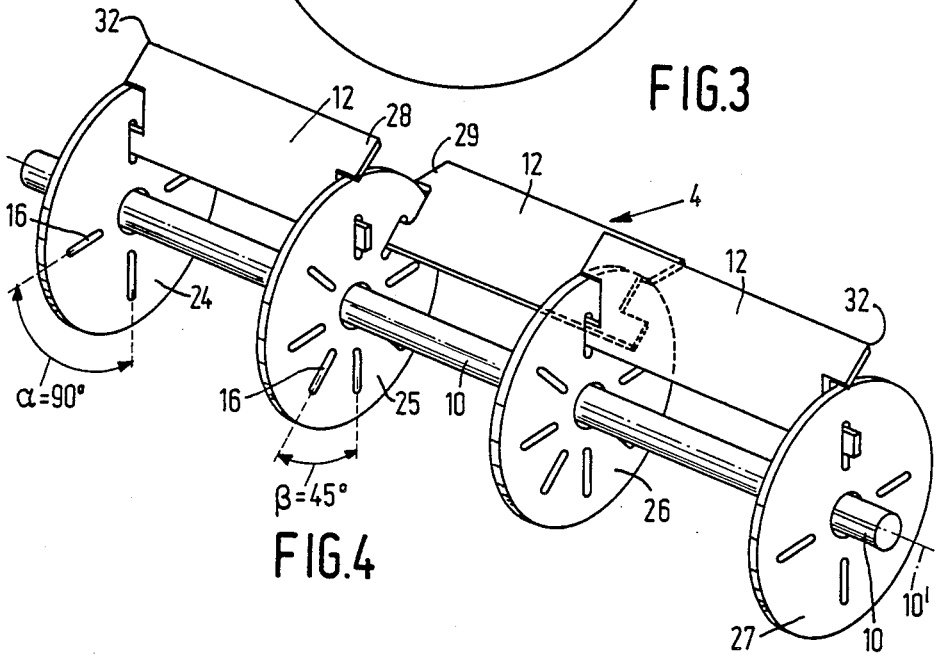
FIG. 4 is a perspective view of another cutter.

FIG. 4 shows a cutter 4 having four discs 24, 25, 26 and 27 mounted on the spindle 10. Between each pair of facing discs four cutting elements 12 are arranged in the same way as in the cutter shown in FIGS. 1 and 2. However, for the sake of clarity only one cutting element is shown between each pair of discs. The cutting elements are regularly distributed on the discs, which means that for the discs 24 and 27 the slots 16 for the connection portions 15 extend along radii from the central axis or axis of rotation 10' of the spindle 10 which enclose an angle $\alpha$ of 90°. Obviously, the discs 25 and 26 are respectively formed with slots 16 for the cutting elements on opposite sides of the discs 25 and 26. These slots may be disposed along radii which enclose an angle $\beta$ of 45°. In this way the cutting elements between the pair of discs 25, 26 are offset from the cutting elements between the pairs of discs 24, 25 and 26, 27.

Figure 5:
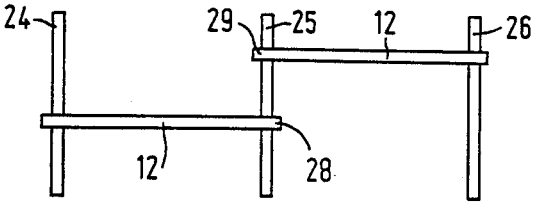
FIG. 5 is a schematic view on a smaller scale showing a part of the cutter of FIG. 4.

Preferably, the axial connecting end portions 28 and 29 (FIG. 5) of the cutting elements overlap one another, so that at the location of the discs there is no zone of the shear plate 3 which is not covered by the cutting elements.

By means of the construction shown in FIG. 4 a cutter of arbitrary axial length can be obtained by the use of an arbitrary number greater than two of discs without the risk that as a result of an excessive length the cutting elements, which would be generally made of a thin sheet material, are bent excessively by the forces K produced during cutting. Such an excessive bending would have an adverse effect on the cutting action. Moreover, long cutting elements, which are comparatively heavy in order to obtain the required rigidity, would also lead to excessive centrifugal forces.

Figure 6:
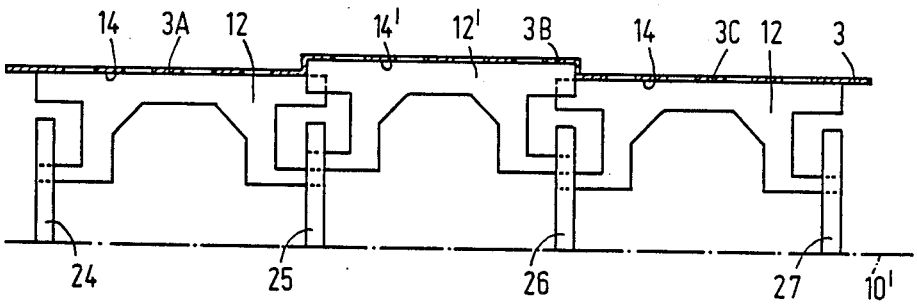
FIGS. 6 and 7 are simplified longitudinal sectional views of modifications of the embodiment shown in FIG. 4.
Figure 7:
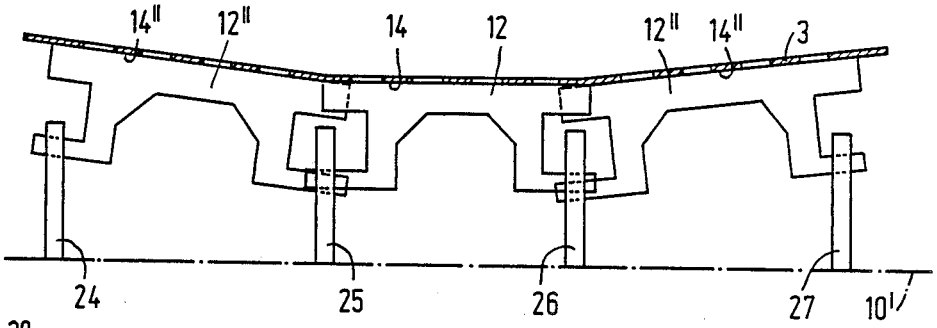

FIGS. 6 and 7 are simplified longitudinal sectional views similar to FIG. 1 showing modifications of the cutter shown in FIG. 4 and also showing the shear plate. In the two modifications the cutting elements are again secured to four discs 24, 25, 26 and 27. In the construction shown in FIG. 6 the cutting elements 12' are positioned between the discs 25 and 26 at a larger diameter than the adjacent cutting elements 12 on the other sides of the discs 25 and 26, so that the distance of the cutting edges 14' of these cutting elements 12' from the axis of rotation 10' is larger than that of the cutting edges 14 of the adjacent cutting elements 12. The shear plate 3 is constructed accordingly with a central portion 3B having a larger distance from the axis of rotation 10' than the adjoining portions 3A and 3C.

In the embodiment shown in FIG. 7 the cutting edges 14 of the cutting elements 12 between the discs 25 and 26 are disposed on a cylindrical surface, whilst the cutting edges 14'' of the cutting elements 12'' on the other sides of the discs 25 and 26 are situated on conical surfaces.

For the sake of simplicity the cutting elements 12, 12' and 12'' in FIGS. 6 and 7 on opposite sides of the discs 25 and 26 are shown in the same plane through the axis of rotation 10'. In reality, however, the cutting elements are arranged offset from each other in the same way as in FIG. 4.

Figure 8:
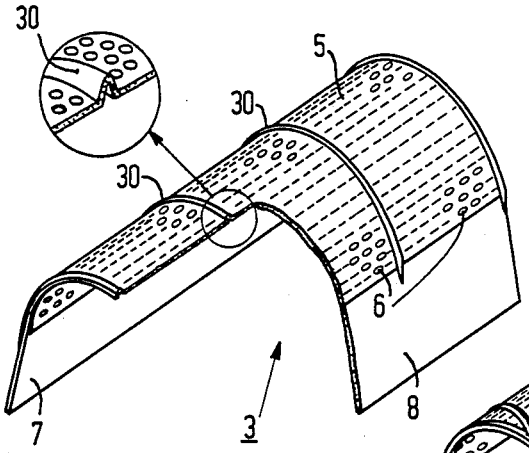
FIGS. 8 and 9 are perspective views of modifications of the shear plate, a portion of the shear plate shown in FIG. 8 being separately shown on an enlarged scale.
Figure 9:
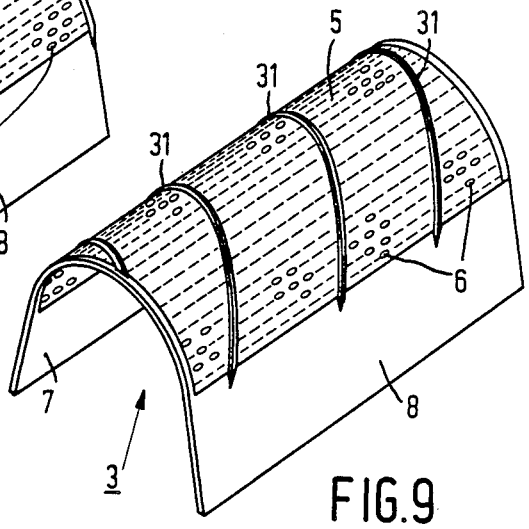

For the shear plate 3 it may also be important in such cases to take steps to increase its rigidity. In the constructions shown in FIGS. 8 and 9, the central portions 5 of the shear plates 3 are formed with channel-shaped raised portions or ridges 30 and 31 respectively which extend between the peripheral portions 7 and 8. In the construction shown in FIG. 6 the ridges 30 extend transversely of the peripheral portions 7 and 8; in the construction shown in FIG. 7 the ridges 31 have a helical shape. This leads to a substantial reinforcement of the shear plate, whilst the ridges also slightly tighten the skin during shaving, which promotes catching of the hairs in the hair-entry apertures 6. Alternatively, the ridges may be provided at the location of the vertices 32 (FIG. 4) at the ends of a cutting element 12, to prevent the shear plate 3 from being damaged in the case of an inclined position of the cutting element with such a vertex 32.

What is claimed is:

1. A dry-shaving apparatus comprising a longitudinally extending shear plate provided with hair-entry apertures; an associated longitudinally extending cutter rotatable about an axis of rotation, said cutter including a spindle coaxially positioned with respect to said axis of rotation; the shear plate having a central portion shaped as a part of a cylindrical surface and formed with the hair-entry apertures, said central portion partly surrounding the cutter; cutting elements movable relative to the cutter in a substantially radial direction, each cutting element having a cutting edge at its radial end; and more than two coaxial discs axially spaced from each other and formed with slots extending in a substantially radial direction, said coaxial discs being rigidly mounted on said spindle; each cutting element having oppositely disposed axially projecting connecting portions for insertion of the cutting element into facing slots in two adjacent discs, the connecting portions being movable in the slots in a substantially radial direction.

2. A dry-shaving apparatus according to claim 1, in which the radial distance of the cutting edges of the cutting elements on one side of a disc from the axis of rotation differs from the radial distance of the cutting edges of the cutting elements on the other side of the disc from the axis of rotation.

3. A dry-shaving apparatus according to claim 1, in which the shear plate is formed with reinforcing ridges.

4. A dry-shaving apparatus comprising a longitudinally extending shear plate provided with hair-entry apertures; an associated longitudinally extending cutter rotatable about an axis of rotation, said cutter including a spindle coaxially positioned with respect to said axis of rotation; the shear plate having a central portion shaped as a part of a cylindrical surface and formed with the hair-entry apertures, said central portion partly surrounding the cutter; cutting elements movable relative to the cutter in a substantially radial direction, each cutting element having a cutting edge at its radial end; and more than two coaxial discs axially spaced from each other and formed with slots extending in a substantially radial direction, said coaxial discs being rigidly mounted on said spindle; each cutting element having oppositely disposed axially projecting connecting portions for insertion of the cutting element into facing slots in two adjacent discs, the cutting elements on opposite sides of a disc being offset from one another and partly overlapping each other, the connecting portions being movable in the slots in a substantially radial direction.

5. A dry-shaving apparatus comprising a longitudinally extending shear plate provided with hair-entry apertures; an associated longitudinally extending cutter rotatable about an axis of rotation, said cutter including a spindle coaxially positioned with respect to said axis of rotation; the shear plate having a central portion shaped as a part of a cylindrical surface and formed with the hair-entry apertures, said central portion partly surrounding the cutter; cutting elements movable relative to the cutter in a substantially radial direction, each cutting element having a cutting edge at its radial end; and more than two coaxial discs axially spaced from each other and formed with slots extending in a substantially radial direction, said coaxial discs being rigidly mounted on said spindle; each cutting element having oppositely disposed axially projecting connecting portions for insertion of the cutting element into facing slots in two adjacent discs, the cutting edges of the cutting elements on one side of a disc being situated on a cylindrical surface, and the cutting edges of the cutting elements on the other side of the disc being situated on a conical surface, the connecting portions being movable in the slots in a substantially radial direction.

6. A dry-shaving apparatus comprising a longitudinally extending shear plate providing with hair-entry apertures; an associated longitudinally extending cutter rotatable about an axis of rotation, said cutter including a spindle coaxially positioned with respect to said axis of rotation; the shear plate having a central portion shaped as a part of a cylindrical surface and formed with the hair-entry apertures, said central portion partly surrounding the cutter; the shear plate also being formed with reinforcing ridges which extend helically relative to the axis of rotation; cutting elements movable relative to the cutter in a substantially radial direction, each cutting element having a cutting edge at its radial end; and more than two coaxial discs axially spaced from each other and formed with slots extending in a substantially radial direction, said coaxial discs being rigidly mounted on said spindle; each cutting element having oppositely disposed axially projecting connecting portions for insertion of the cutting element into facing slots in two adjacent discs, the connecting portions being movable in the slots in a substantially radial direction.

* * * * *